US006030139A

United States Patent [19]

Ray

[11] Patent Number: 6,030,139

[45] Date of Patent: Feb. 29, 2000

[54] FLANGED COVER WITH PRONGS FOR A RING BINDER ASSEMBLY

[75] Inventor: Gustav Ray, Huntington Beach, Calif.

[73] Assignee: Avery Dennison Corporation, Pasadena, Calif.

[21] Appl. No.: 09/169,166

[22] Filed: Oct. 8, 1998

[51] Int. Cl.[7] ..... B42F 3/04

[52] U.S. Cl. ..... 402/31; 402/36; 402/75; 402/37; 402/39; 402/42

[58] Field of Search ..... 402/36, 75, 31, 402/37, 38, 42, 39

[56] References Cited

U.S. PATENT DOCUMENTS

| | | | |
|---|---|---|---|
| 991,393 | 5/1911 | Thompson . | |
| 1,051,527 | 1/1913 | Thompson . | |
| 1,473,247 | 11/1923 | Newman . | |
| 1,494,626 | 5/1924 | Pitt | 402/13 |
| 1,550,050 | 8/1925 | Schade . | |
| 1,575,450 | 3/1926 | Newman . | |
| 1,670,130 | 5/1928 | Watson | 402/37 |
| 1,711,161 | 4/1929 | Trussell | 402/77 |
| 1,733,503 | 10/1929 | Maas et al. | 402/13 |
| 1,771,104 | 7/1930 | Watson . | |
| 1,841,793 | 1/1932 | Dawson . | |
| 1,915,140 | 6/1933 | Watson | 402/39 |
| 1,943,465 | 1/1934 | Watson . | |
| 2,052,665 | 9/1936 | Schade . | |
| 2,282,624 | 5/1942 | Upson et al. . | |
| 2,562,518 | 7/1951 | Abrams . | |
| 2,632,657 | 3/1953 | Schade . | |
| 2,751,139 | 6/1956 | Young . | |
| 2,760,490 | 8/1956 | Schade . | |
| 2,772,427 | 12/1956 | Rankin . | |
| 2,888,934 | 6/1959 | Segal . | |
| 3,197,729 | 7/1965 | Sarazen . | |
| 3,302,221 | 2/1967 | Zysman . | |
| 4,295,747 | 10/1981 | Errichiello | 402/75 |
| 4,582,442 | 4/1986 | Rager | 402/75 |
| 4,697,945 | 10/1987 | Geiger | 402/75 |
| 4,722,628 | 2/1988 | Rager | 402/75 |
| 4,886,390 | 12/1989 | Silence et al. | 402/42 |
| 4,935,998 | 6/1990 | Frazier et al. | 24/350 |
| 4,990,017 | 2/1991 | Rotherham | 402/75 |
| 5,035,526 | 7/1991 | Cooper et al. | 402/75 |
| 5,100,253 | 3/1992 | Cooper | 402/75 |
| 5,160,209 | 11/1992 | Schuessler | 402/75 |
| 5,772,348 | 6/1998 | To | 402/36 |

FOREIGN PATENT DOCUMENTS

| | | | |
|---|---|---|---|
| 529799 | 7/1954 | Belgium | 402/39 |
| 4689/06 | of 1906 | United Kingdom | 402/36 |

*Primary Examiner*—Willmon Fridie, Jr.
*Assistant Examiner*—Alisa Thurston
*Attorney, Agent, or Firm*—Oppenheimer Wolff & Donnelly LLP

[57] ABSTRACT

A system for rivetless attachment of a ring binder assembly to a cover wherein an attachment portion including one or more prongs adapted to imbeddingly engage a cover substrate and a surface adapted to mate in facing relation with a surface of the cover is formed unitary with a confining spring cover plate of the ring binder assembly, the ring binder assembly being attached to the cover by forcing the attachment portion against it with sufficient force to drive the prongs into the substrate and hold the surface of the attachment portion firmly against the cover.

25 Claims, 9 Drawing Sheets

FLANGED COVER WITH PRONGS FOR A RING BINDER ASSEMBLY

BACKGROUND OF THE INVENTION

1. Field of the Invention

This invention relates generally to binders for releasably retaining and organizing apertured paper. More particularly, the invention relates to a system for attaching a ring binder assembly to a cover of such a notebook.

2. Description of the Related Art

Notebook binders for releasably retaining apertured paper sheets and the like therein are well known. Conventionally, a ring binder assembly, for example one comprising three sets of mating pairs of half-rings for releasably holding apertured paper, is attached to a spine or back cover of a notebook cover. The cover comprises a substrate, which provides shape and strength enabling the protective function of the cover and typically comprises segments for the spine and front and back covers all usually formed of the same or of similar material, typically comprising a substrate composed of cardboard, chipboard, or the like. The substrate is covered by a flexible protective and aesthetically pleasing material such as a textile or an elastomeric film.

For purposes of illustration, choosing the case of a cover employing a polymeric resin film, typically the spine and front and back cover substrate segments are each confined within an individual compartment formed by placing them on a first sheet of polymeric resin film and overlaying these with a second sheet of polymeric resin film and thermally welding the two films together around the edges of each of the substrate segments. The outer periphery of the notebook is defined by cutting the film away at the outer thermal weld surrounding the three substrate segments. Typically, this forms a notebook cover having plastic hinges at the thermal weld portions between the spine and the front and back covers; and in the present specification and claims, it is to be understood that the notebook "cover" includes both the front and back cover and the spine.

A ring binder assembly is thereafter conventionally attached to the notebook cover by driving rivets through the spine or back cover of the notebook cover. The rivets are received through holes in the ring binder assembly, and typically driven against an anvil which deforms the rivets on the side of the ring binder assembly which will face inwardly in the completed notebook binder.

In a three-ring notebook, for example, typically two rivets are used intermediate the three rings. Rounded heads of the rivets are visible outside the notebook on the outer surface of the notebook cover.

This riveted construction has been founds by some to be objectionable for a number of reasons. As an example, the outer film of the cover, which, as mentioned, can be formed of plastic, is sometimes found to wrinkle in the location of the rivet head on the outside surface of the notebook binder cover. Likewise, if the covering of the binder cover is of cloth or another material susceptible to deformation a wrinkle can occur.

In another example, in one popular binder construction the outer cover of the binder is overlain with an additional film of clear plastic material. This allows insertion of customized printed matter between the clear plastic film and the film comprising the envelope surrounding the substrate forming the rigid components of the spine and front and back covers. The rivets can interfere with insertion of the printed matter and holes must be formed in the clear plastic cover film to mitigate this problem. However, this adds to the complexity of assembling such binders, and so to their cost. Also, even though the outer plastic film is not riveted to the cover because of the holes, papers being inserted between the outer plastic film and the cover may catch on the rivet heads and wrinkle and resist insertion. This is sometimes annoying to users of such binders.

As another example, it may be desirable to eliminate rivets or other fasteners for the reason that they may mar certain surfaces with which they come in contact. For example, metal rivet heads on the outside of the cover may scratch or dent soft wood surfaces. Also, exposed rivet heads may themselves be marred, for example, having a color paint applied to match the rest of the notebook cover they can become scratched, giving an unsightly appearance. In addition, a plain spine is more aesthetically pleasing, in the opinion of some, than one which has rivets along its surface.

Having recognized these disadvantages relating to aesthetic considerations and convenient use of the binder, attempts have been made to create a binder system which does not employ rivets which extend through the notebook cover to the outside of the binder. For example, U.S. Pat. No. 5,160,209 issued to Schuessler on Nov. 3, 1992 discloses a means of fastening a binder ring assembly to a cover, wherein the fastening arrangements are concealed from an outer surface of the binder. This prior system employs separate anchor plate elements which each include numerous prongs on a bottom surface which, when pressed downwardly into a binder spine or cover substrate, embed themselves therein and hold firmly in place. The anchor plates further include posts which, like rivets of previous constructions, are received through holes in the ring binder assembly. The upper ends of the posts are subsequently deformed, for example, by expanding and flattening, to retain the ring binder assembly on the posts.

The system disclosed in Schuessler '209 patent eliminates the difficulties described above connected with having a rivet extend through the binder cover. The prongs of the anchor plates terminate within a substrate segment of the cover, for example, the spine substrate, and accordingly do not present the aesthetic and functional difficulties mentioned. Nevertheless, the Schuessler system does involve using separate fastening elements comprising the anchor plate elements disclosed. Accordingly, manufacturing costs associated with using separate anchor plate elements in the construction are inherent in this system.

In this and other constructions where separate connecting elements or fasteners such as rivets are used to attach the ring binder assembly to the notebook cover at least one additional manufacturing step is necessitated materials and labor costs are thus added.

There is accordingly a need and desire for a more economical and simple system for a notebook binder construction. The present invention is directed to this need.

SUMMARY OF THE INVENTION

It has been recognized that it would be desirable to eliminate the need for using a separate connecting or fastening element to secure the ring binder assembly to the spine. Substantial cost savings may be realized in eliminating the extra element, if a sufficiently simple alternative construction might be used.

Briefly, and in general terms, the invention provides a simplified and improved ring binder system for notebooks including a ring binder assembly further comprising a confining cover spring plate member which includes a unitary attachment portion having at least one attachment prong. The system also includes an over-center toggle plate having a plurality of binder half-rings attached. The over-center toggle plate is carried by and cooperates with the confining cover spring plate member to provide a first, closed, position and a second, open, position for the binder half-rings. This gives rise to a recloseable ring opening action, with the toggle plate action, a confining spring plate action and ring action being conventional, of course. The system further includes a notebook cover comprising a substrate which is formed of a material adapted to receive the attachment prong or prongs in an imbedded anchoring position therein to affix the attachment portion of the cover plate member to the cover.

In a more detailed aspect, a notebook in accordance with the inventive concept can be made by forming the confining cover plate member with an attachment portion by folding or extending a portion of the cover plate to form a flange adapted to rest against the notebook cover. Also, one or more attachment prongs are formed in the attachment portion of the confining cover spring plate member comprising the flange by cutting at least one claw shape in the plate and pushing the claw shape out, bending it to form the prong extending outwardly from the attachment portion of the confining cover plate. This can be done at the time the confining cover spring plate member is being formed. The attachment portion being an integral part of the ring binder assembly gives the result that the ring binder assembly is attached without additional parts. The prong can be one of many used, and in manufacturing of a notebook binder it is forced into the substrate so that the flange rests against the notebook cover and the ring binder assembly is fixedly attached to the notebook cover on its inward side. The prong or prongs will not protrude outside the cover and remain hidden thereafter.

In another more detailed aspect, the attachment portion can be formed by cutting the confining cover spring plate and folding out metal to form a flange having a surface adapted to mate with the spine, the prong or prongs being formed in the flange. Moreover, the flange can be folded back on itself to provide an allowance for deformation of the confining cover plate member as the toggle plate is moved over-center from a first at-rest position to a second at-rest position. Further, the flange can be folded out to the side of the confining cover plate member to provide for convenient access by a tool to press the attachment portion into a substrate. The flange can also be folded back under the ring binder assembly to conceal it from view, and a space is maintained between the flange and the assembly so that a tool can be inserted therebetween in order to provide pressure to force the flanges comprising the attachment portions down against a spine or cover segment of a notebook cover.

In a further detailed aspect, holes formed in the confining cover plate member when the flanges comprising the attachment portions are cut out and bent over and outward and away from the rest of the confining cover spring plate member can accommodate the half-ring pairs extending upwardly through the confining cover plate member. As will be appreciated, this avoids the necessity to form holes specifically to accommodate the half-rings of half-ring pairs, for example, which retain apertured paper in a notebook binder.

As can be appreciated, the unitary construction of the ring binder system according to the present invention eliminates the need for separate fastening elements and can result in substantial cost savings in manufacture and a more aesthetically pleasing appearance of notebook binders. These and other advantages will become apparent with reference to the following detailed description and accompanying drawings, which are given by way of example, and to the appended claims.

DETAILED DESCRIPTION OF THE PREFERRED EMBODIMENT(S)

Figure 1:
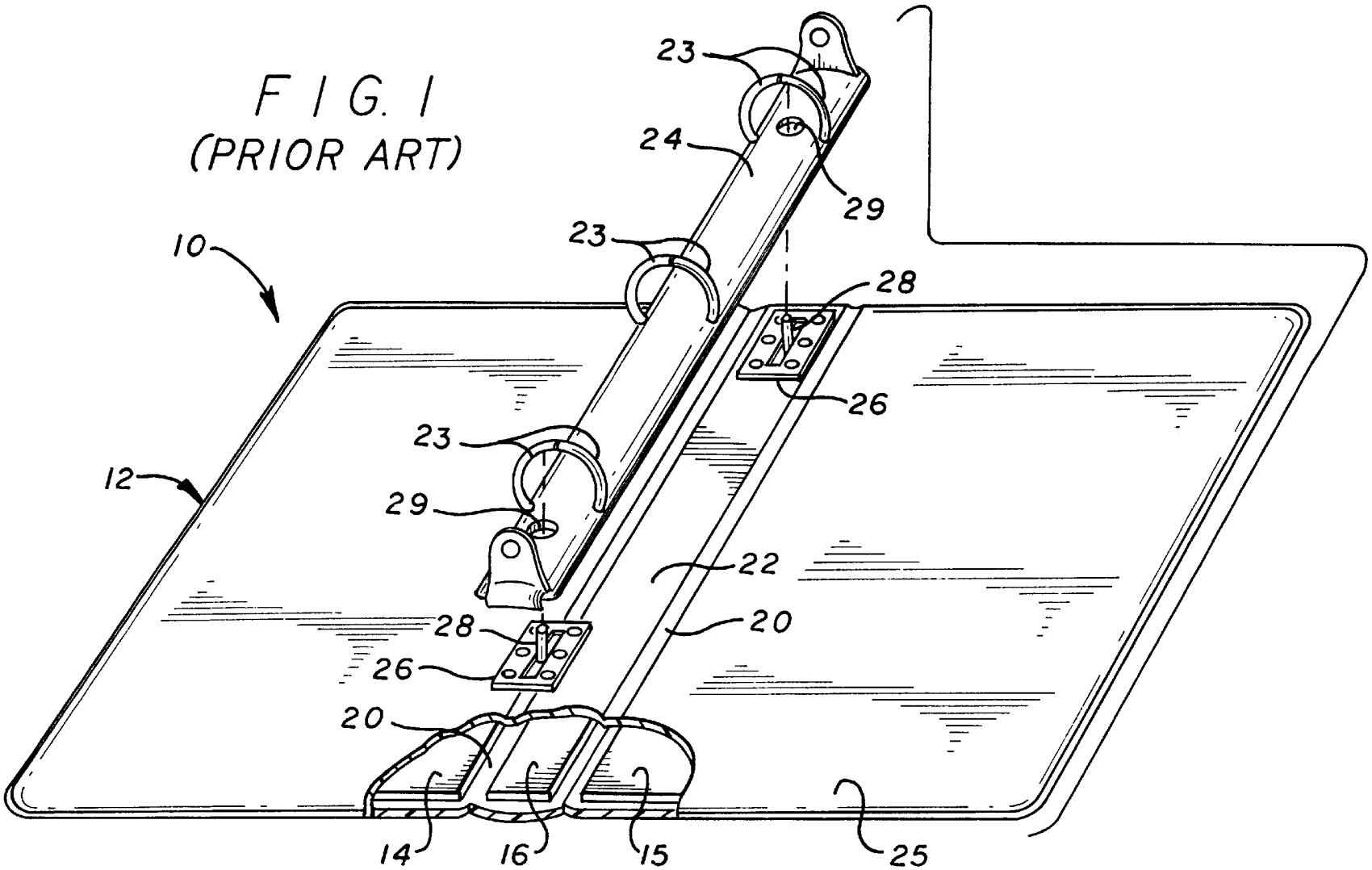
FIG. 1 (PRIOR ART)
FIG. 1 is a perspective partially exploded view of a prior-art ring binder construction.

With reference to FIG. 1 of the drawings, which are given by way of example, the environment of the invention is illustrated by a prior art notebook 10 comprising a cover 12 which includes front and back cover substrate segments 14, 15 and a spine cover substrate segment 16 covered by an outer protective and aesthetic cover layer 18 which completely envelopes the substrate segments 14, 16. The substrate segments are conventionally formed of a fairly rigid material such as cardboard or chipboard. The outer protective aesthetic cover layer can be formed from an elastomeric polymer resin or can comprise fabric, for example. The substrate segments lend strength and rigidity to the notebook cover 12, while the outer protective aesthetic cover layer functions to hold the substrate members together and lend a pleasing appearance to the notebook cover.

A hinge 20 formed by welding or otherwise joining the outer protective aesthetic cover layers 18 above and below the substrate segments 14, 15, 16 between the front and back cover substrate segments and the spine substrate segment defines a spine 22 separated from the rest of the cover 12 by the hinges 20. One example of how this is done is to form the outer protective aesthetic cover layer from a polymeric resin and to form the hinges 20 by thermally welding overlaying and underlying films of the outer protective cover layer material around the outer periphery of each substrate member as described above.

A ring binder assembly 24 is attached to the cover 12, for example on the spine 22. The ring binder assembly includes typically two or three sets of mated half-rings 23 which engage apertured paper (not shown) for organized retention in the notebook 10. The binder assembly is sometimes attached to the cover 12 at a location other than on the spine, for example on a rear cover segment 25. In any case in prior notebooks this is typically done using separate connecting elements such as rivets or other fasteners.

One object of prior art notebook constructions was to join a ring binder assembly 24 to the cover 12 without driving rivets through the spine 22 or rear cover 25 for example to do so. One approach is illustrated in the prior art notebook 10 shown. Two identical anchor plates 26 are used to effect a fixed and permanent attachment of the ring binder assembly 24 to the binder cover 12 without rivets which extend through the cover.

The anchor plates in each case comprise a stamped metal plate including prongs (not shown) which extend downwardly and engage the spine substrate 16 in the illustrated example when driven therein by pressing the anchor plates against the spine 22 with considerable force. Each anchor plate 26 further includes a post 28 which engages the ring binder assembly by virtue of deformation of a top portion of the post after the binder assembly has been placed on the posts by means of holes 29 configured to receive the posts to provide a mechanical engagement between the anchor plates and the ring binder assembly.

Figure 2:
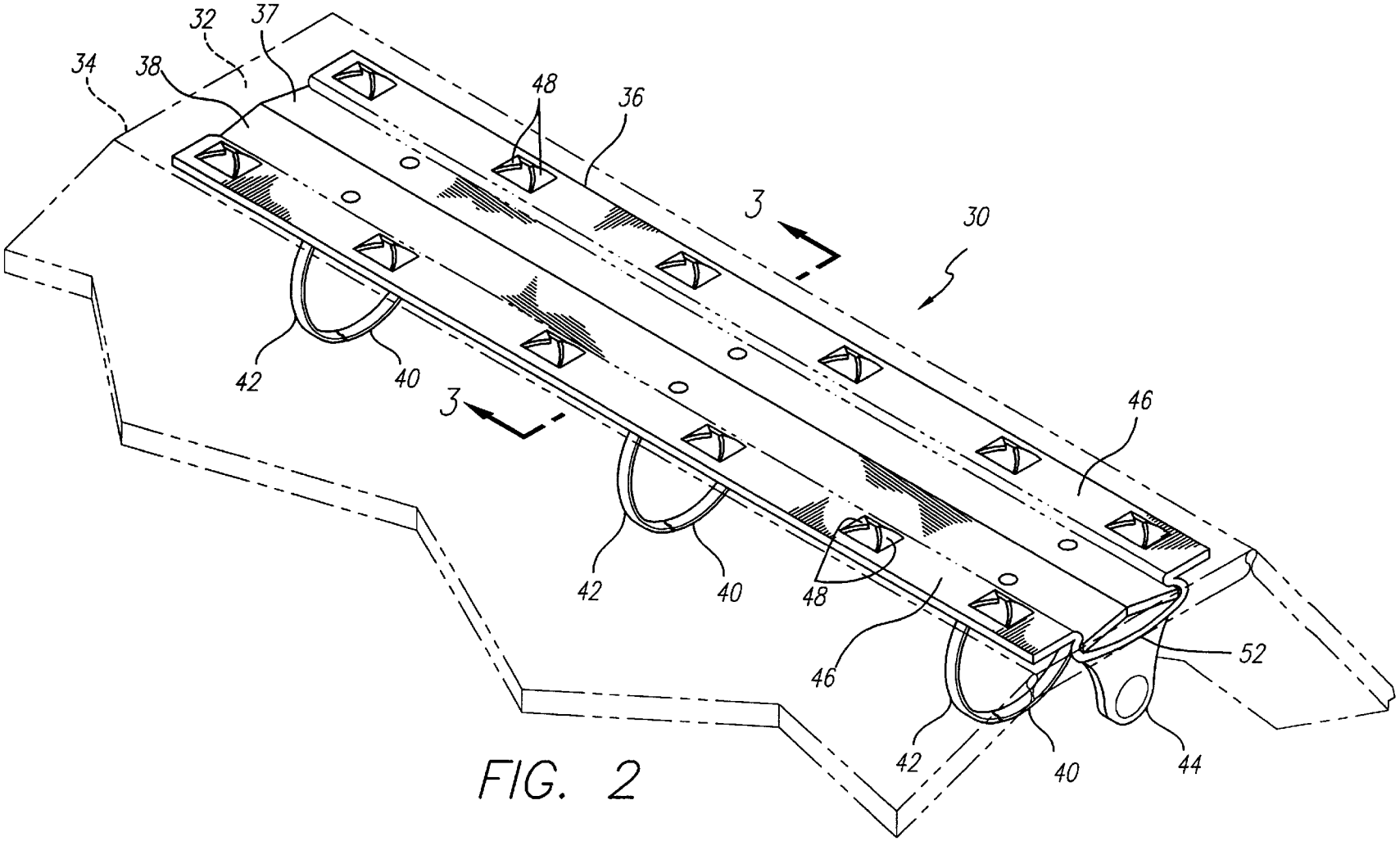
FIG. 2 is a perspective bottom view of a ring binder system illustrating the principles of the present invention.
Figure 3:
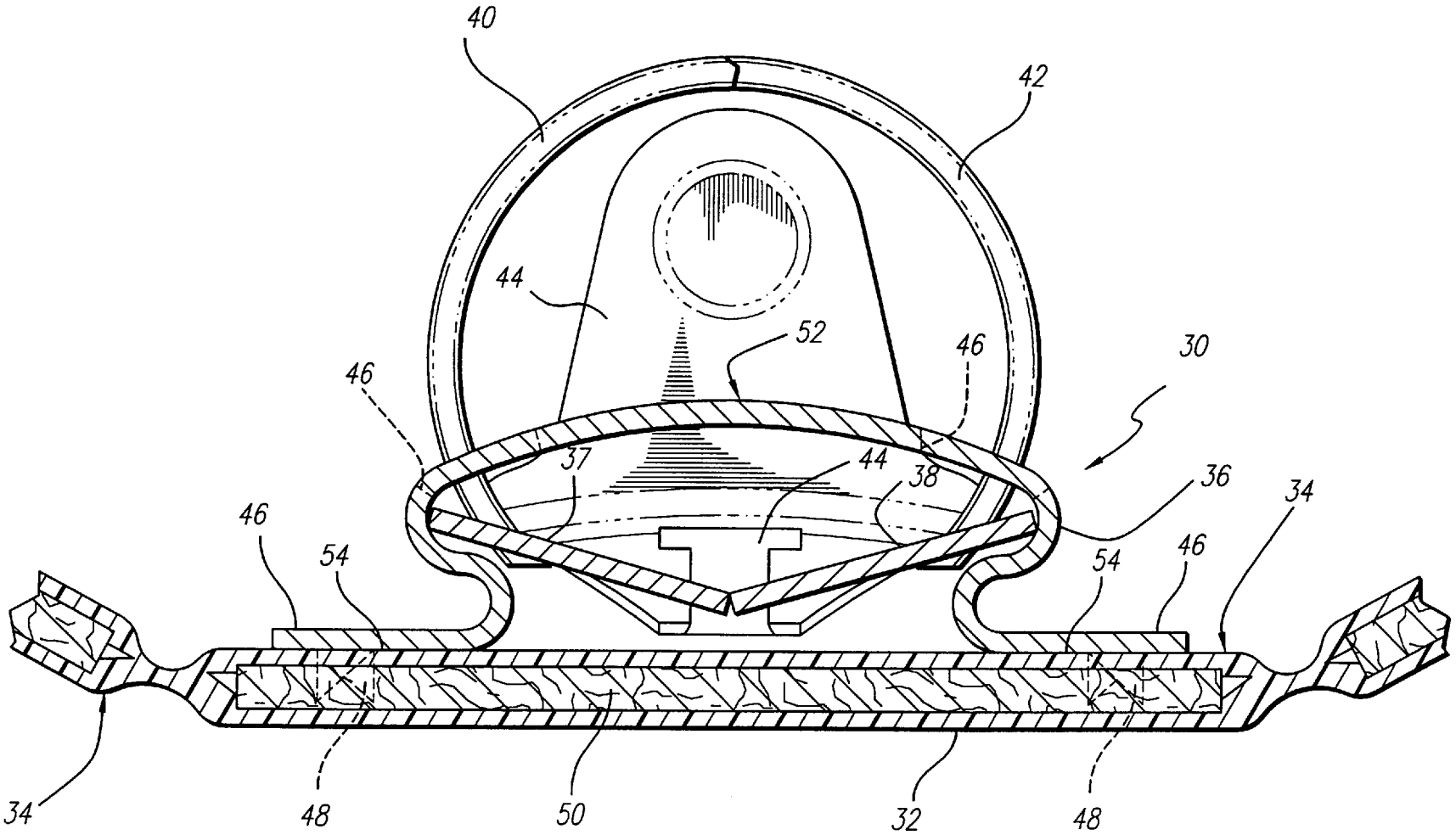
FIG. 3 is a cross-sectional view rotated 180 degrees, of the ring binder shown in FIG. 2 taken along line 3—3 in FIG. 2.

Contrastingly, the provision of a separate element, comprising each anchor plate 26, for example, is eliminated in the simplified construction in accordance with the present invention, an example of which is shown in FIGS. 2 and 3. In accordance with the invention's aesthetic and functional concerns associated with riveted constructions are mitigated, as are cost considerations associated with prior constructions having a separate anchoring element. The exemplary embodiment provides for attachment of a ring binder assembly 30 to a spine 32, for example, of a notebook cover 34 without rivets or separate elements such as the anchor plates (26 in FIG. 1) previously described. Cost savings are realized in elimination of manufacturing steps and in assembling separate components by providing a ring binder assembly in which the means of attaching the ring binder assembly to the cover is formed unitary with a containing cover spring plate 36 of the ring binder assembly.

In the illustrated embodiment this is done by forming the ring binder confining cover spring plate 36 from a single piece of metal material, such as steel having an appropriate modulus of elasticity. The confining cover spring plate is formed to provide an overall confining shape in order to hold two toggle plates 37 and 38 which are fixedly coupled to binder half-rings 40, 42 providing an over-center spring construction as is well known in the art. This construction allows the binder assembly 30 to provide an open position and a closed position for the toggle plates and half-rings to provide selective access to add or remove apertured paper (not shown) from the binder as is also well known in the art.

A lever 44 is provided at each of two ends of the ring binder assembly. These two levers are configured to move the toggle plates 37, 38 between the first and second positions corresponding with closed and open positions for the binder half-rings. Each half ring 40, 42 extends through a hole 46 formed in the confining cover plate 36, as is customary in ring binder assemblies.

In the present illustrated embodiment, however, the confining cover spring plate 36 further includes a flange 46 on each side of the confining cover spring plate which has been formed into a confining shape to enclose and provide over-center spring action in association with the toggle plates 37, 38 as best appreciated with reference to FIG. 3. Sufficient allowance for accommodation of deformation is made in the shape of the finished confining cover spring plate so that in opening and closing the binder half-rings 40, 42 the flanges will not be pushed outward so far as to overcome resistance provided by anchoring prongs 48 which engage a spine substrate segment 50 formed of cardboard or chipboard for example. A relatively thinner metal plate may be used to form the confining cover spring plate in this embodiment than is used in conventional binder ring assemblies due to the increased resistance to deformation of the continuing cover spring plate the configuration affords.

Again, with reference to FIGS. 2 and 3, the claw-like prongs 48 are formed by die-cutting and stamping processes, and these can be contemporary with formation of the confining cover spring plate 36 of the ring binder assembly 30. The prongs can be formed for example when the part is die-cut from metal plate stock. The prongs are configured to have a slightly outward- or inward-turning configuration. An inward-turning configuration is shown. This is provided so that the prongs will bend further inwardly or outwardly to engage the substrate in a claw-like fashion when they are pressed into a substrate segment such as the substrate segment 50 of the spine 32 for example. Further, the prongs do not penetrate through the spine substrate to provide an unsightly appearance on an outside portion of the cover 34.

The flange 46 is made to extend outward from a central portion 52 of the confining cover spring plate 36 a sufficient distance that in attaching the ring binder assembly 36 to the cover 34 during manufacture a tool (not shown) can extend down and engage the flanges 46 and with a considerable force drive the prongs into the substrate 50. The flanges 46 comprise a surface 54 which is pressed against the cover 34 in facing relation thereto; and after assembly the surface is held snugly against the cover by the anchoring action of the prongs 48. The flanges, with unitary prongs 48 and surfaces 54 comprise attachment portions of the confining cover spring plate 36 and serve to attach the ring binder assembly 30 to the cover.

Figure 4:
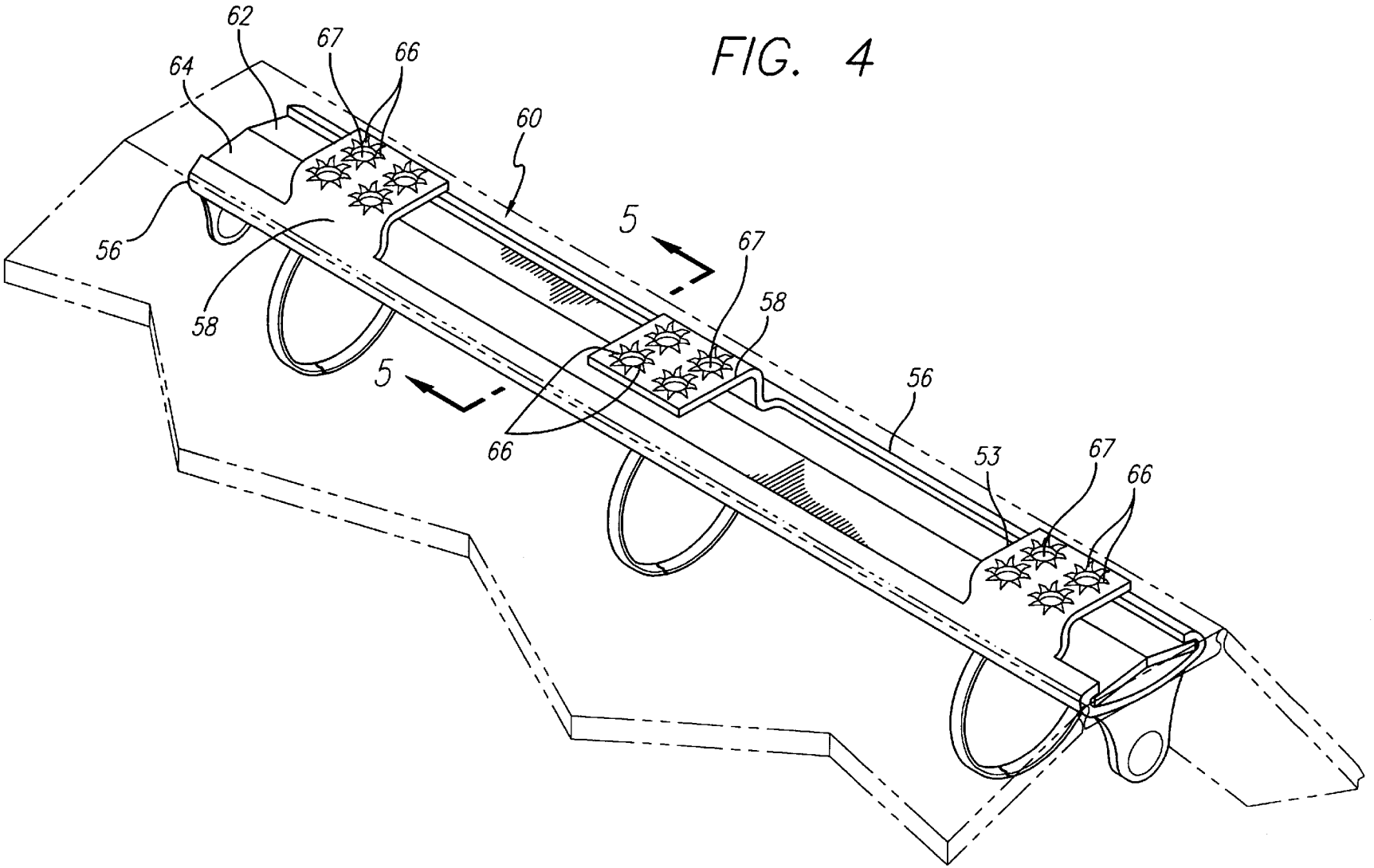
FIG. 4 is a perspective view of a further embodiment of the ring binder system according to the invention.
Figure 5:
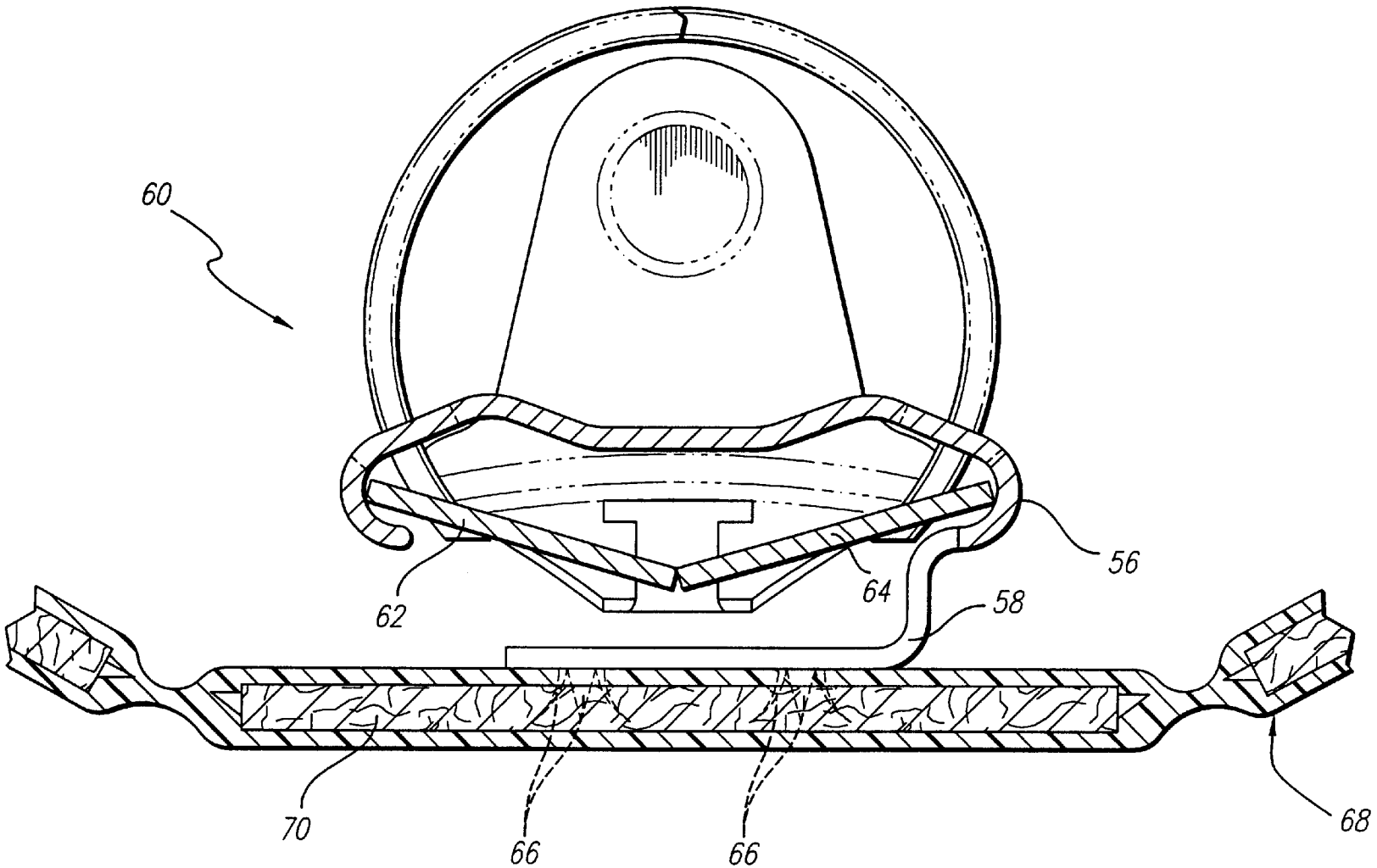
FIG. 5 is a cross-section view taken along line 5—5 and rotated 180 degrees, of the ring binder system shown in FIG. 4.

With reference to FIGS. 4 and 5, in another embodiment of the invention a confining cover spring plate 56 is formed with flanges 58 which comprise tabs formed unitary with the confining cover spring plate. The flanges are bent in an L-shape underneath a ring binder assembly 60 of which they are a part. The flanges are given an L-shape so that sufficient space is provided between the flange and toggle plates 62, 64 that a tool (not shown) can be inserted to apply force to the flanges. This is important in manufacturing, as the flanges comprise attachment portions in this embodiment and considerable force must be applied that will not deform the flanges in an undesirable way.

Each of the unitary flanges 58 includes anchoring prongs 66 so that the confining cover spring plate 56 can be attached to the cover 68 in a manner similar to that described above. The anchoring prongs are also formed by a stamping process where they are cut and pushed out from the flange portion of the confining cover spring plate. In this case they are formed in a star shape surrounding a central opening 67 formed by their being cut and pushed out from the plate. As before described, they are given a slight outward curvature so that when pressed into a substrate 70 they continue to bend. In this case the prongs are given an outward curvature, and continue to bend outwardly from the central opening as they are driven into the substrate material comprising cardboard or chipboard for example.

In general, multiple prongs 66 can be formed in this way by cutting lines intersecting at a common point, the lines bisecting corners of a polygon shape having a number of sides corresponding to the number of prongs desired. For example, a square hole will produce four triangular prongs instead of two shown in the previously described embodiment. Likewise, a pentagon shape will produce five prongs, and a hexagon, six prongs, etc. The prongs will be arranged around a polygon shaped opening formed by bending the prongs outwardly from the plate 56, each prong having at its tip portion of the plate formerly at the center of the polygonal shaped opening, and at its base the prong joins unitary with plate along a fold comprising a base portion of the prong 66.

The flanges 58 are staggered in placement along the ring binder assembly 60. This is so that the tool mentioned above can engage them, extending feet (not shown) underneath the ring binder assembly from opposite sides between the flange 58 and the toggle plates 62, 64, to press down the flanges 58 comprising the attachment portion of the confining cover spring plate 56 in this embodiment and drive the prongs 66 into the substrate 70.

Figure 6:
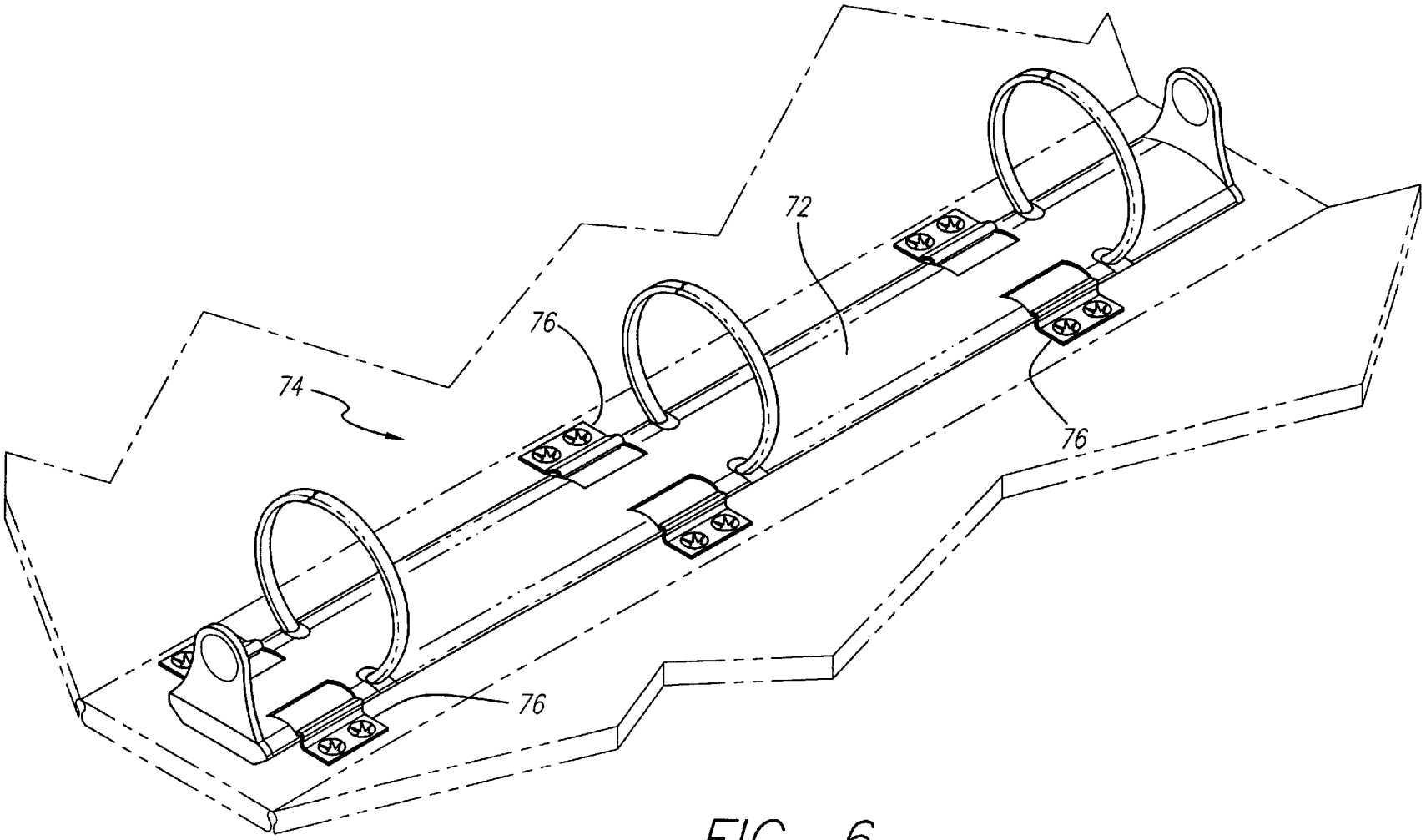
FIG. 6 is a perspective view of another embodiment of the invention in a ring binder assembly.

Another embodiment of the invention is shown in FIG. 6. This embodiment differs from the previously described embodiments in that attachment portions of a confining cover spring plate 72 of a ring binder assembly 74 comprise flanges 76 which are cut from the confining cover spring plate and folded outwardly and downwardly. As can be appreciated in longitudinal section the flanges would be seen to form an L-shape extending downward and outward from the ring binder assembly. Otherwise this embodiment is similar to those previously described. The configuration is advantageous in that the confining cover spring plate need not be cut larger, or cut in irregular patterns to form extending tabs or flanges (to later be bent inwardly or outwardly). Materials cost savings are thus realized.

Figure 7:
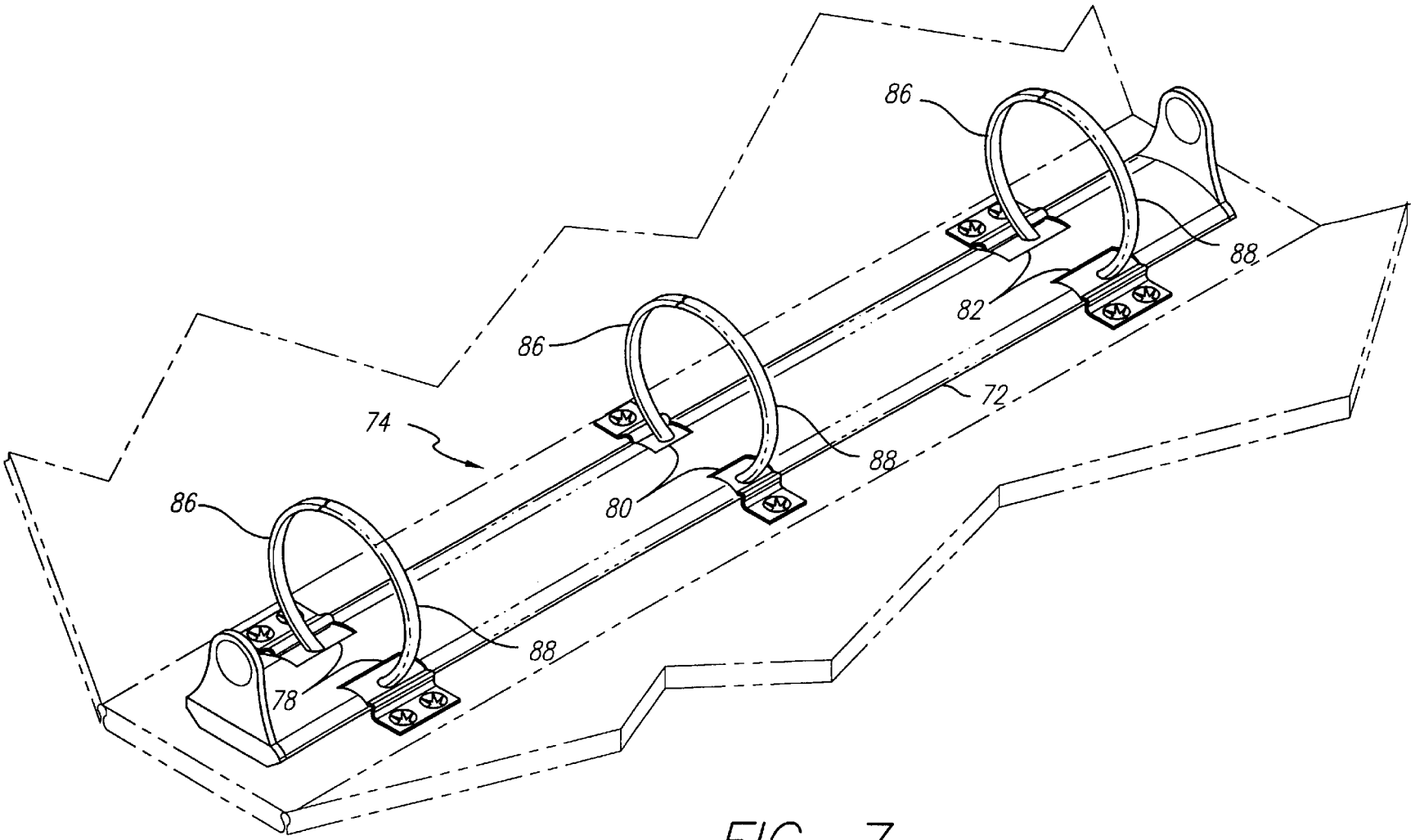
FIG. 7 is a perspective view of another ring binder assembly according to the present invention.

With reference to FIG. 7, a variation from the configuration just described is illustrated. The fact that openings 78, 80, 82 are formed when material from the confining cover spring plate 72 is cut and bent out and down to form the flanges 76 comprising the attachment portions is exploited. By forming such flanges whereby the ring binder assembly 74 is attached to a cover 84, and consequently openings, at locations where they can be used for the openings needed to allow the binder half-rigs 86, 88 to pass through the confining cover spring plate the construction is further simplified. This configuration saves having to punch additional holes for the half-rings to pass through, and additional cost savings are realized in this embodiment.

Figure 8:
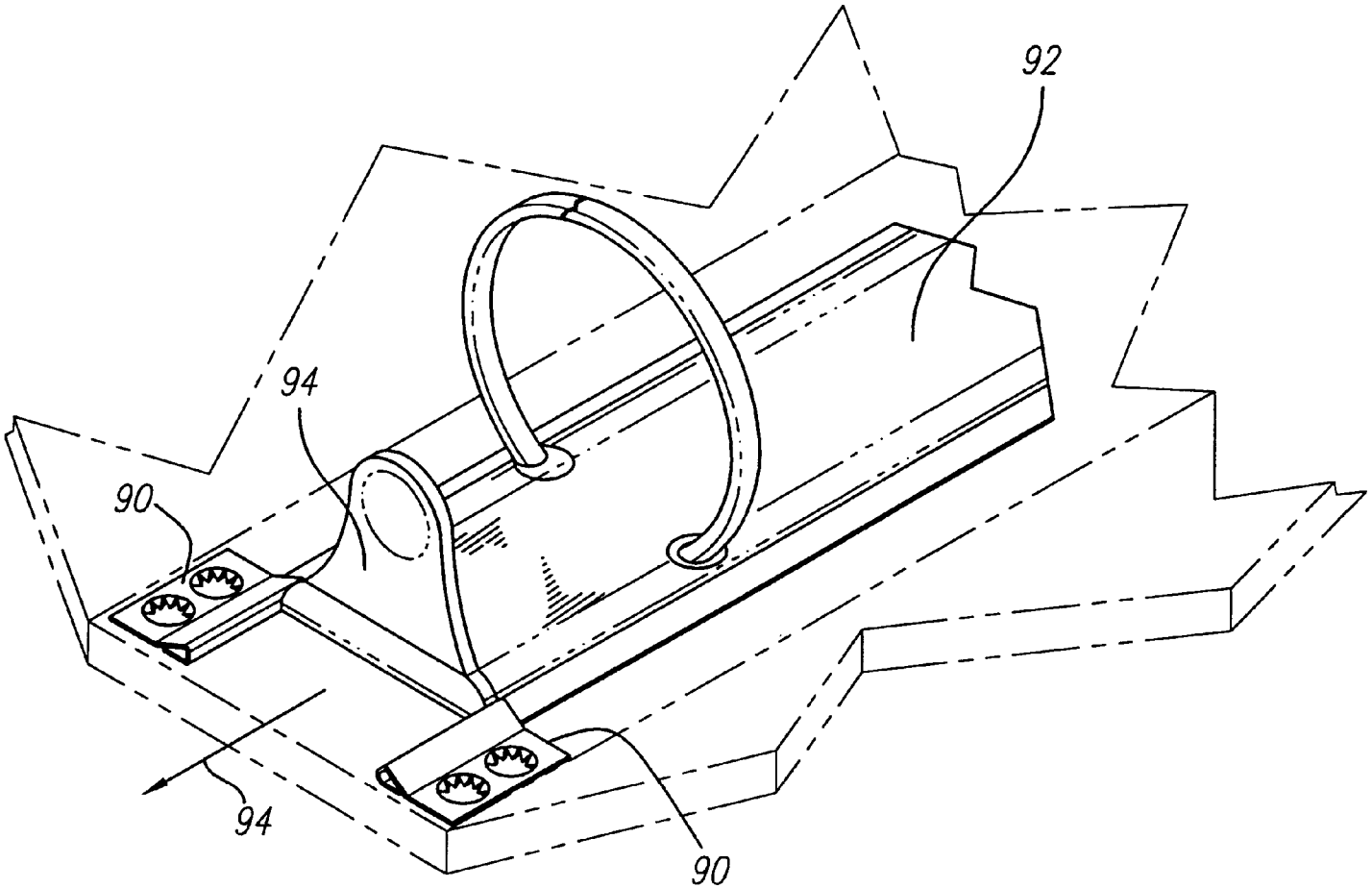
FIG. 8 is a perspective view of a portion of a ring binder assembly illustrating another embodiment of the invention.
Figure 9:
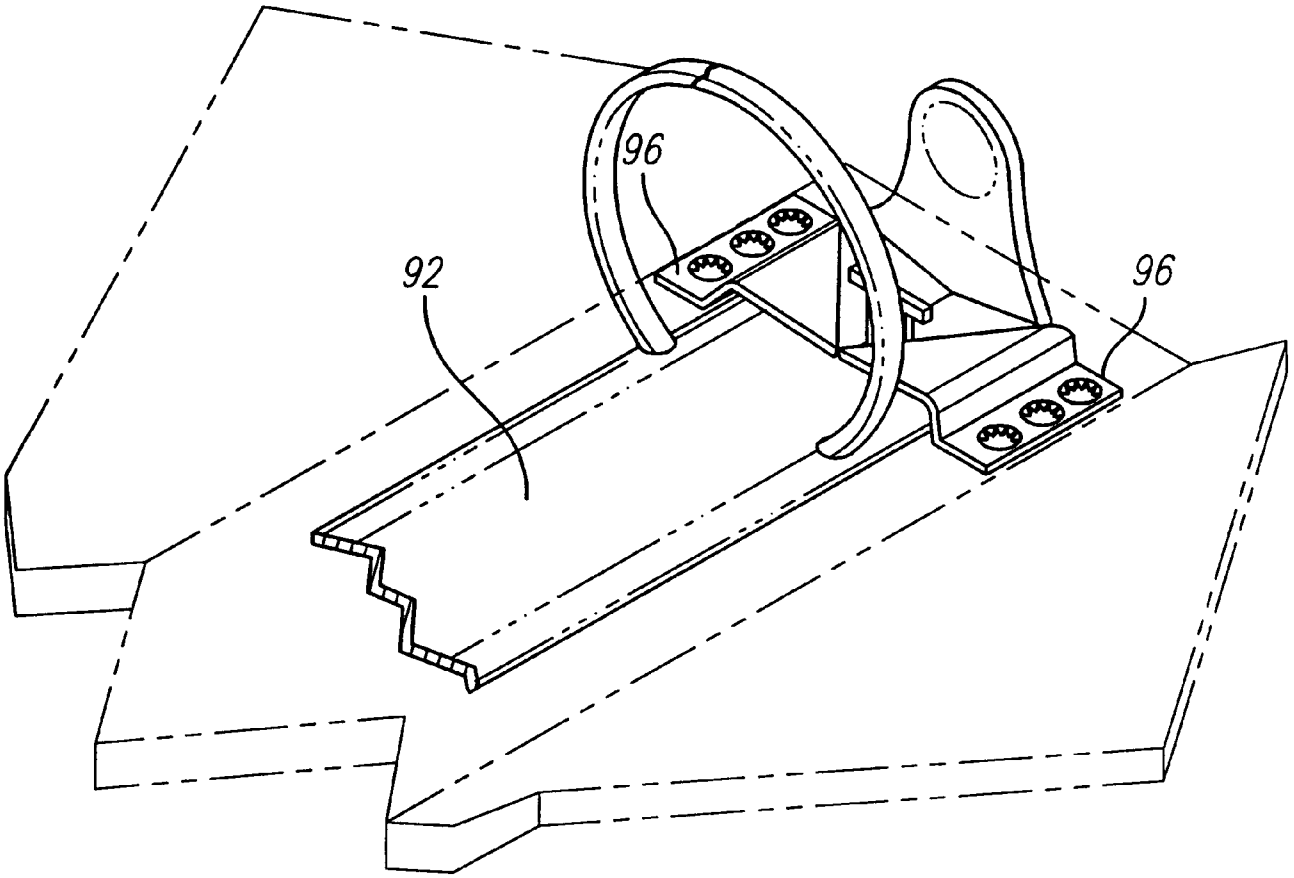
FIG. 9 is a perspective view illustrating another embodiment of the invention.

Another embodiment is shown in FIG. 8 in which the attachment portions comprise tabs 90 formed by cutting axially a confining cover spring plate 92, formed initially longer in an axial direction 94 than is otherwise necessary, to a point 94 comprising the location of the finished end of the confining cover spring plate and longitudinally at that point and turning the tabs back outwardly. The configuration is otherwise similar to that described above. Alternatively, the tabs can be made initially longer, and can be folded back over the top of the confining cover spring plate and then down and outwardly to form the attachment portion 96 illustrated in FIG. 9.

As will be appreciated from the forgoing, the simplified construction disclosed provides advantages in cost and ease of manufacture in comparison to known systems for attaching ring binder assemblies to a cover in making ring binder products. At the same time the system disclosed mitigates the problems associated with use of additional elements such as rivet fasteners or separate anchor plate elements, or the like, mentioned above.

While particular embodiments of the invention have been illustrated and described herein it will be appreciated that these are given only by way of example, and that various modifications and alterations can be made within the spirit and scope of the invention. Accordingly, by way of example and not of limitation, the ring assembly may be secured to any desired portion of the cover of the notebook, for example to the spine or to either the front or back cover members adjacent to the spine. It is further noted that, as employed in the specification and claims, the terms "rings," "ring binder assembly," and the like is intended to include all types of perforated paper engagement, or paper clamping, or holding arrangements. It is not intended that the scope of the invention be limited except by the appended claims.

I claim:

1. In a ring binder notebook including a ring binder assembly for releasably retaining apertured sheets in a notebook, the ring binder assembly being attached to a notebook cover and the assembly including a confining cover spring member having first and second ends and sides, the confining cover spring being elastically expandable outwardly at the sides and a toggle plate coupled to a plurality of half-rings, the toggle plate being confined within and carried by the confining cover spring member, the improvement comprising:

an attachment portion formed unitary with the confining cover spring member, the attachment portion further comprising a flange formed unitary with the confining cover spring member and adapted to mate in facing relation to the cover of the notebook, said flange extending from a side of the confining cover spring;

at least one prong formed unitary with the flange and adapted to be driven into and be anchored within the notebook cover in anchoring engagement therewith to fixedly hold the flange against the cover, said flange and confining cover spring member being configured to elastically deform so as to accommodate outward elastic deformation of the confining cover spring in over-center spring action in opening and closing of the half-rings without dislodging the prong from the notebook cover;

whereby the confining spring cover member of the ring binder assembly is directly attached to the cover without additional separate fastener parts.

2. The improved ring binder notebook of claim 1, wherein the confining cover spring member comprising attachment portions is formed from a unitary metal plate.

3. The improved ring binder notebook of claim 2, wherein the flange of the attachment portion is cut from the confining cover spring member in a shape defining the flange but for where it attaches to the confining cover spring member, the flange being folded outwardly from the confining spring cover member to form a facing surface configured to rest against an inner surface of the notebook cover.

4. The improved ring binder notebook of claim 3, wherein said at least one attachment prong is formed unitary with the flange.

5. The improved ring binder of claim 4, wherein the attachment portion comprises a plurality of attachment prongs having an inclination from the facing surface to facilitate further bending as the prongs are driven into the penetrable substance comprising the notebook cover.

6. The improved ring binder notebook of claim 5, wherein the prongs are arranged around a periphery of a central opening defined by the flange which opening is formed when the prongs are formed by bending out and away from the flange.

7. The improved ring binder notebook of claim 3, wherein openings defined by the confining cover spring member are formed by cutting and bending out the flange comprising the attachment portion and said openings are aligned with the notebook binder half rings such that the half-rings extend through the openings thus formed in the confining cover spring member.

8. The improved ring binder notebook of claim 3, wherein the flange is folded to facilitate deformation of the confining cover spring member as the toggle plate is moved without pulling the prongs out from the notebook cover.

9. The improved ring binder notebook of claim 2, wherein the attachment portion comprises a flange defined by a tab unitary with the plate forming the confining spring cover plate, the tab being folded to form the flange of the attachment portion.

10. The improved ring binder notebook of claim 9, wherein the flange is folded under the confining cover spring member of the ring binder assembly so as to be screened from view in an assembled ring binder notebook by the confining spring cover member.

11. A method of attaching a ring binder assembly including a confining cover spring plate having first and second ends and sides, the confining cover spring plate being elastically deformable outwardly at the sides, and a toggle plate having an attached plurality of binder half-ring segments to a notebook cover including a penetrable substrate, comprising:

forming an attachment portion in the confining cover spring plate by folding a portion of the confining cover spring plate to form a flange, said flange extending from a side of the confining cover spring plate and said flange having a mating surface adapted to rest against a notebook cover in facing relation thereto, said flange and confining cover spring plate being configured to elastically deform so as to accommodate outward elastic deformation of the confining cover spring plate in over-center spring action in opening and closing of the half-rings without dislodging the prong from the notebook cover;

forming at least one attachment prong in said cover plate by cutting a prong shape in the attachment portion of the cover plate and pushing said prong shape out from the plate;

forcing the prong into the substrate so that the mating surface of the flange rests against the notebook cover and the prong is anchored in the substrate, whereby the ring binder assembly is fixedly attached to the notebook cover.

12. The method of claim 11, further comprising the step of cutting a portion of the cover plate and bending it outward to form the flange including the mating surface.

13. The method of claim 12, further comprising the steps of:

cutting the portion of the confining cover spring plate to form the flange at a location in alignment with a half-ring segment;

assembling the ring binder assembly so that the half-ring extends through the confining cover spring plate through the opening defined by cutting the confining cover spring plate to form the flange.

14. The method of claim 11, further comprising the step of forming the flange so as to accommodate deformation of the confining cover spring plate in conjunction with opening and closing the half-rings wherein the toggle plate moves over-center and the confining spring plate deforms elastically.

15. A ring binder system for notebooks, comprising:

a ring binder assembly further comprising:

a confining spring cover plate having first and second ends and sides, the confining spring cover plate being elastically deformable outwardly at the sides, the confining spring cover plate including a unitary attachment portion including at least one flange extending from a side of the confining spring cover plate, the flange further including an attachment prong;

an over-center toggle plate having a plurality of binder half rings attached thereto, the over-center toggle plate being carried by and cooperating with the confining spring cover plate to provide a first closed position and a second open position for the binder half rings enabling a reclosable binder ring opening action;

a notebook cover including a substrate comprising a layer of material adapted to receive the attachment prong in imbedded anchored position therein, the attachment portion attaching the confining spring cover plate to the notebook cover;

said flange and confining spring cover plate being configured to elastically deform so as to accommodate outward elastic deformation of the confining spring cover plate in over-center spring action in opening and closing of the half-rings without dislodging the prong from the notebook cover.

16. The ring binder system of claim 15, wherein the confining spring cover plate further comprises tabs which are bent to form the attachment portion.

17. The ring binder system of claim 15, wherein the confining spring cover attachment portion comprises a flange formed by cutting the confining spring cover plate in a shape defining the flange and bending it out from the confining spring cover plate, thereby defining an opening in the confining spring cover plate.

18. The ring binder system of claim 17, wherein the openings in the confining spring cover plate defined by formation of the flange accommodate the half-rings which extend through the confining spring cover plate.

19. The ring binder system of claim 17, wherein the flange accommodates deformation of the confining cover plate, whereby the attachment prongs remain imbedded in the substrate regardless of deformation of the confining cover spring plate in opening and closing the binder half-rings.

20. The ring binder system of claim 15, wherein the attachment portions extend outwardly from the confining cover spring plate so as to be accessible to a tool pressing down in attaching the ring binder assembly to the notebook cover.

21. In a ring binder notebook including a ring binder assembly for releasably retaining apertured sheets in a notebook, the ring binder assembly being attached to a notebook cover and the assembly including a confining cover spring member and a toggle plate coupled to a plurality of half-rings, the toggle plate being confined within and carried by the confining cover spring member, the improvement comprising:

an attachment portion formed unitary with the confining cover spring member from a metal plate, the attachment portion further comprising a flange formed unitary with the confining cover spring member and adapted to mate in facing relation to the cover of the notebook, wherein the flange of the attachment portion is cut from the confining cover spring member in a shape defining the flange but for where it attaches to the confining cover spring member, the flange being folded outwardly from the confining spring cover member to form a facing surface configured to rest against an inner surface of the notebook cover, and wherein openings defined by the confining cover spring member are formed by cutting and bending out the flange comprising the attachment portion and said openings are aligned with the notebook binder half rings such that the half-rings extend through the openings thus formed in the confining cover spring member;

at least one prong formed unitary with the flange and adapted to be driven into and be anchored within the notebook cover in anchoring engagement therewith to fixedly hold the flange against the cover, whereby the confining spring cover member of the ring binder assembly is directly attached to the cover without additional separate fastener parts.

22. A method of attaching a ring binder assembly including a confining cover spring plate and a toggle plate having an attached plurality of binder half-ring segments to a notebook cover including a penetrable substrate, comprising:

forming an attachment portion in the confining cover plate by cutting and folding a portion of the cover plate to form a flange at a location in alignment with a half-ring segment, the flange having a mating surface adapted to rest against a notebook cover in facing relation thereto;

assembling the ring binder assembly so that the half-ring extends through the confining cover spring plate through the opening defined by cutting the confining cover spring plate to form the flange;

forming at least one attachment prong in said cover plate by cutting a prong shape in the attachment portion of the cover plate and pushing said prong shape out from the plate;

forcing the prong into the substrate so that the mating surface of the flange rests against the notebook cover and the prong is anchored in the substrate, whereby the ring binder assembly is fixedly attached to the notebook cover.

23. A ring binder system for notebooks, comprising:

a ring binder assembly further comprising:

a confining spring cover plate, the confining spring cover plate including a plurality of unitary attachment portions further comprising flanges formed by cutting the confining spring cover plate in shapes defining the flanges and bending the flanges out from the confining spring cover plate, thereby defining a plurality of openings in the confining spring cover plate, wherein the openings in the confining spring cover plate defined by formation of the flanges accommodate the half-rings which extend through the confining spring cover plate at the locations of said openings, each flange further comprising a mating surface;

at least one attachment prong formed in each mating surface;

an over-center toggle plate having a plurality of binder half rings attached thereto, the over-center toggle plate being carried by and cooperating with the confining spring cover plate to provide a first closed position and a second open position for the binder half rings enabling a reclosable binder ring opening action;

a notebook cover including a substrate comprising a layer of material adapted to receive the attachment prongs in imbedded anchored position therein, the attachment portion attaching the confining spring cover plate to the notebook cover.

24. The ring binder system of claim 23, wherein the flange accommodates deformation of the confining cover plate, whereby the attachment prongs remain imbedded in the substrate regardless of deformation of the confining cover spring plate in opening and closing the binder half-rings.

25. The ring binder system of claim 24, wherein the attachment portions extend from the confining cover spring plate so as to be accessible to a tool pressing down in attaching the ring binder assembly to the notebook cover.

* * * * *